US007347487B2

(12) United States Patent
Kojima et al.

(10) Patent No.: US 7,347,487 B2
(45) Date of Patent: Mar. 25, 2008

(54) FLOOR STRUCTURE OF CONSTRUCTION MACHINE AND METHOD OF ASSEMBLING THE SAME

(75) Inventors: Kenta Kojima, Hiroshima (JP); Tadashi Shirogami, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 714 days.

(21) Appl. No.: 10/806,229

(22) Filed: Mar. 23, 2004

(65) Prior Publication Data

US 2004/0187409 A1 Sep. 30, 2004

(30) Foreign Application Priority Data

Mar. 31, 2003 (JP) ..... 2003-096415

(51) Int. Cl.
*B60N 3/00* (2006.01)

(52) U.S. Cl. ..... 296/190.08; 296/97.23

(58) Field of Classification Search ..... 296/97.23, 296/190.08, 190.01, 193.07; 180/90.6; 52/177, 52/181

See application file for complete search history.

(56) References Cited

FOREIGN PATENT DOCUMENTS

JP 2584492 11/1998

OTHER PUBLICATIONS

Patent Abstracts of Japan, JP 2003-020682, Jan. 24, 2003.
Patent Abstracts of Japan, JP 2002-220194, Aug. 6, 2002.
Patent Abstracts of Japan, JP 2001-294069, Oct. 23, 2001.
Patent Abstracts of Japan, JP 2001-047924, Feb. 20, 2001.
Patent Abstracts of Japan, JP 2000-177653, Jun. 27, 2000.
Patent Abstracts of Japan, JP 2000-017691, Jan. 18, 2000.

*Primary Examiner*—Jeanette Chapman
*Assistant Examiner*—Jessica Laux
(74) *Attorney, Agent, or Firm*—Oblon, Spivak, McClelland, Maier & Neustadt, P.C.

(57) ABSTRACT

A method of assembling a floor structure of a construction machine is based upon the machine with a stepwise part that is located at a lower level on the outside is formed on the end edge of a floor plate as a floor structure. In case of a cabin specification with a cabin mounted, a device for opening and closing a door is housed in the stepwise part with the stepwise part filled in, and a first floor mat having a substantially constant thickness is mounted on the floor plate. In case of a canopy specification having a canopy, a second floor mat having on its end edge a protrusion which is fitted into the stepwise part instead of the device to fill the part is mounted on the floor plate. Accordingly, the same floor plate can be employed in both cabin and canopy specifications, regardless of the specification, thereby reducing the number of parts constituting the floor structure.

3 Claims, 7 Drawing Sheets

FLOOR STRUCTURE OF CONSTRUCTION MACHINE AND METHOD OF ASSEMBLING THE SAME

BACKGROUND OF THE INVENTION

1. Field of the Invention

The present invention relates to a floor structure of a construction machine and a method of assembling the same.

2. Description of the Related Art

Cabs of construction machines are classified into a cabin specification and a canopy one. In both specifications, on a floor of the cab is disposed a floor plate, on which a floor mat having a substantially constant thickness is laid.

In the cabin specification, as disclosed in Japanese Utility Model Registration No.2584492, for example, a door open-close device is attached to a platform of the cabin which an operator is getting on or off. In this case, a stepwise part is formed on the platform of the floor plate so as to provide a space to accommodate the door open-close device.

On the other hand, in the canopy specification, since there is no door open-close device, a substantially flat floor plate is assembled into the floor without this stepwise part.

To assemble the floor structure as mentioned above, however, two types of floor plates, that is, the floor plates with and without the stepwise part need to be prepared depending on the specification. This increases the number of parts including the floor plates and associated components, disadvantageously resulting in decrease in productivity, and additionally leading to increase in manufacturing costs.

SUMMARY OF THE INVENTION

It is an object of the present invention to provide a floor structure of a construction machine that can employ the same floor plate in both cabin and canopy specifications, regardless of type of the specification, and a method of assembling the same.

The floor structure of a construction machine according to the present invention has the following basic structure.

That is, the floor structure of the present invention comprises a canopy disposed above an operator's seat via a support, a floor plate disposed below the operator's seat and having a stepwise part at its end edge on a platform side for an operator, the stepwise part being formed so as to be located at a lower level in a downward direction, and a floor mat covering the floor plate. This floor mat has a protrusion corresponding to the stepwise part, and is wanted on the floor plate in such a manner that the protrusion of the floor mat is fitted into the stepwise part to fill in the stepwise part, thereby substantially leveling an upper surface of the floor mat.

A method of assembling a floor structure according to the present invention has the following basic steps.

That is, the method of assembling a floor structure in the present invention comprises the steps of forming a stepwise part at an end edge of a floor plate constituting the floor structure in such a manner that the stepwise part is located at a lower level outside of the floor plate, and then, on assembling the floor structure, when the floor structure is for a cabin specification on which a cabin with a door is mounted, housing a device for opening and closing the door in the stepwise part to fill in the stepwise part, while mounting on said floor plate a first floor mat having a substantially constant thickness, and on the other hand, on assembling the floor structure, when the floor structure is for a canopy specification on which a canopy without a door is mounted, mounting on the floor plate a second floor mat having a protrusion corresponding to the stepwise part, instead of the device. In the latter case, this protrusion is disposed at an end edge of the second floor mat, and fitted into the stepwise part in such a manner that said protrusion fills in said stepwise part.

In this case, in use of the cabin specification structure with the cabin mounted thereon, the device for opening and closing the door is housed in the stepwise part of the floor plate to fill in the stepwise part, so that the first floor mat with a substantially constant thickness may be mounted on the floor plate.

On the other hand, in use of the canopy specification structure without having a door, the second floor mat with the corresponding protrusion (convex portion) provided at its end edge is mounted on the floor plate, so that the stepwise part of the floor plate is filled in with the protrusion. This makes it possible to employ the floor plate in both the cabin specification and the canopy specification, regardless of type of the specification, thereby reducing the number of parts constituting the floor, thus leading to a decrease in manufacturing costs.

DESCRIPTION OF THE PREFERRED EMBODIMENTS

A method of assembling a floor structure of a construction machine, and a floor mat of the floor structure according to the present invention will be described below with reference to FIGS. 1 to 7 corresponding to the following respective preferred embodiments of the present invention.

Cabs of construction machines are classified into a cabin specification having a cabin with an openable door for a platform, which an operator gets on or off, and a canopy specification in which a roof is supported via a support so as to be located above an operator's seat without an openable door.

Now, a hydraulic excavator will be explained as an example of the construction machine.

Figure 1:
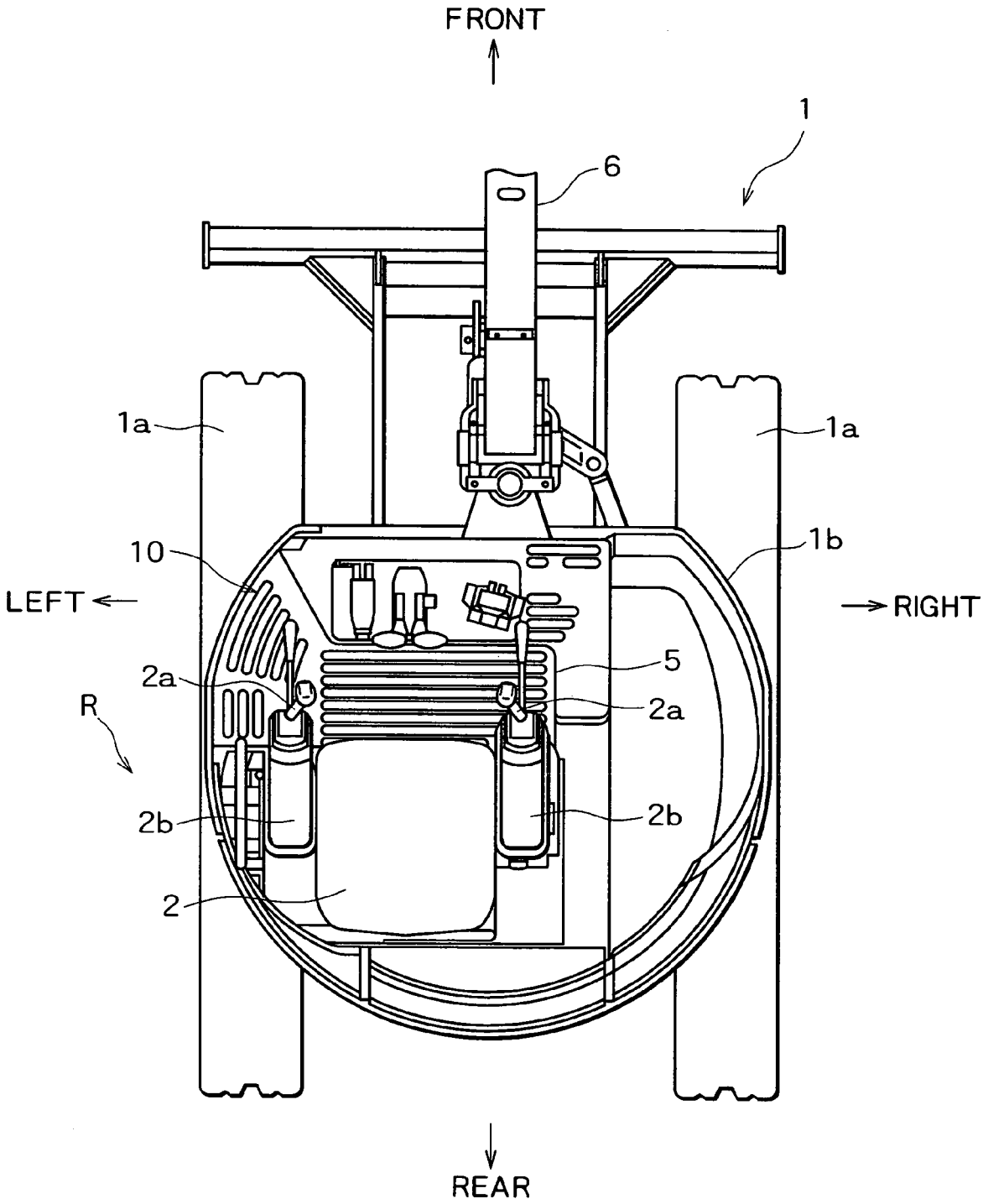
FIG. 1 is a plan view of a hydraulic excavator to which a floor structure of the present invention is applied.
Figure 2:
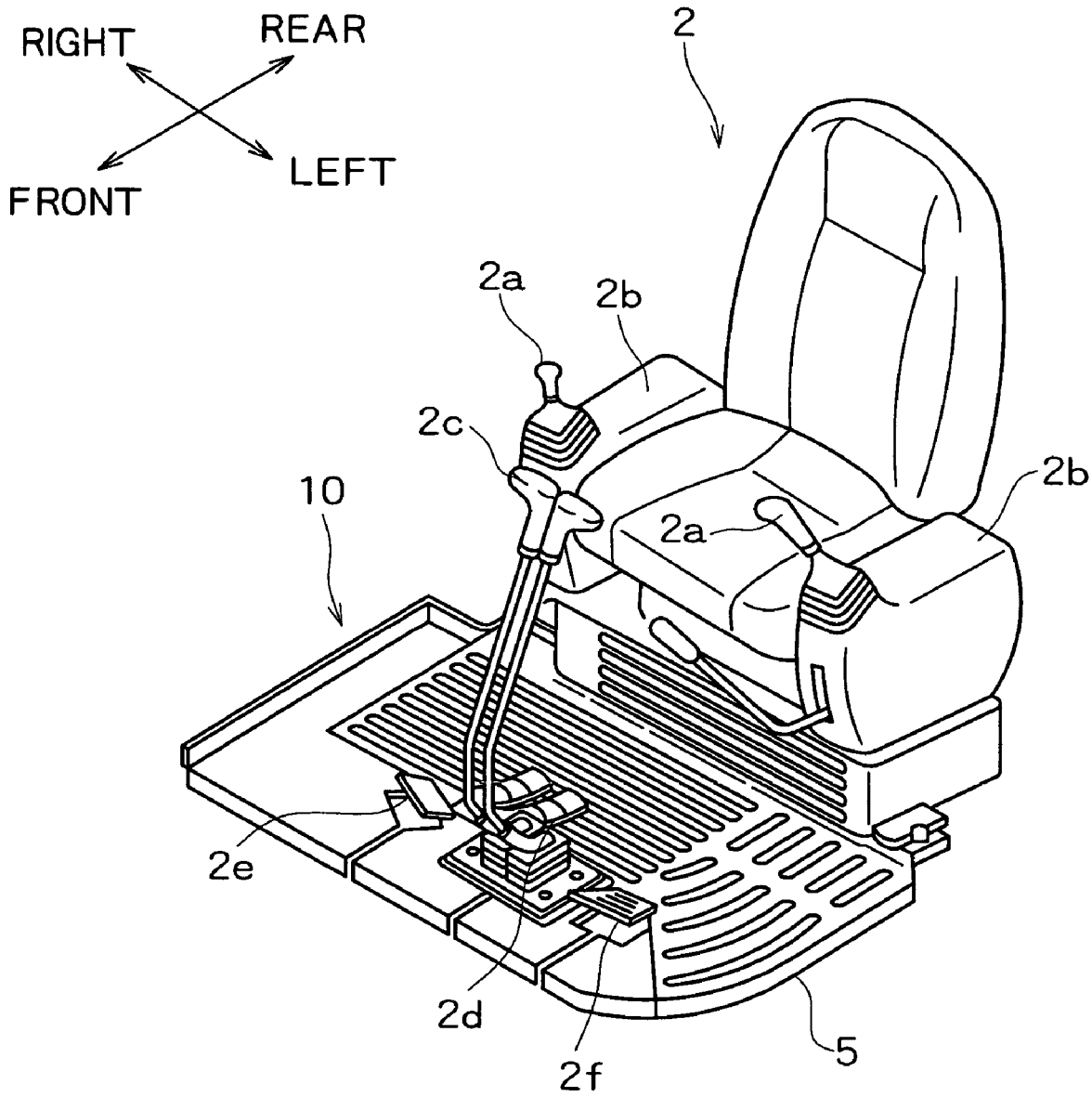
FIG. 2 is a perspective view showing an operator's seat part of FIG. 1.

FIG. 1 is a plan view of a hydraulic excavator to which the floor structure of the present invention is applied. FIG. 2 is a perspective view showing an arrangement of a cab and a floor mat.

In FIGS. 1 and 2, the hydraulic excavator 1 is an excavator of the rear small-swing type (excavator with short tail swing radius, with zero tail swing overhang from crawlers, or with no overhang tail from crawlers while swing can be made the most of when used in a work site). An upper rotating body 1*b* is rotatably mounted on a lower traveling body with a crawler 1*a* attached thereto. On the left side of the upper rotating body 1*b*, a space for a cab R is provided.

In the cab R is mounted an operator's seat 2 for an operator. On the right and left sides of the seat, control boxes 2*b*, each having an operating lever 2*a*, are disposed. In either cabin specification or canopy specification, a floor plate 4 which will be described later is disposed below the operator's seat 2 (under operator's feet). A first floor mat 5 is mounted on this floor plate 4.

It should be noted that a traveling lever 2*c*, a traveling pedal 2*d*, a swing pedal 2*e* for swinging a boom 6 in a lateral direction, and an optional pedal 2*f* for operating an optional device such as a breaker, or an earth discharging plate are protruded from the front part of the operator's seat 2.

Figure 3:
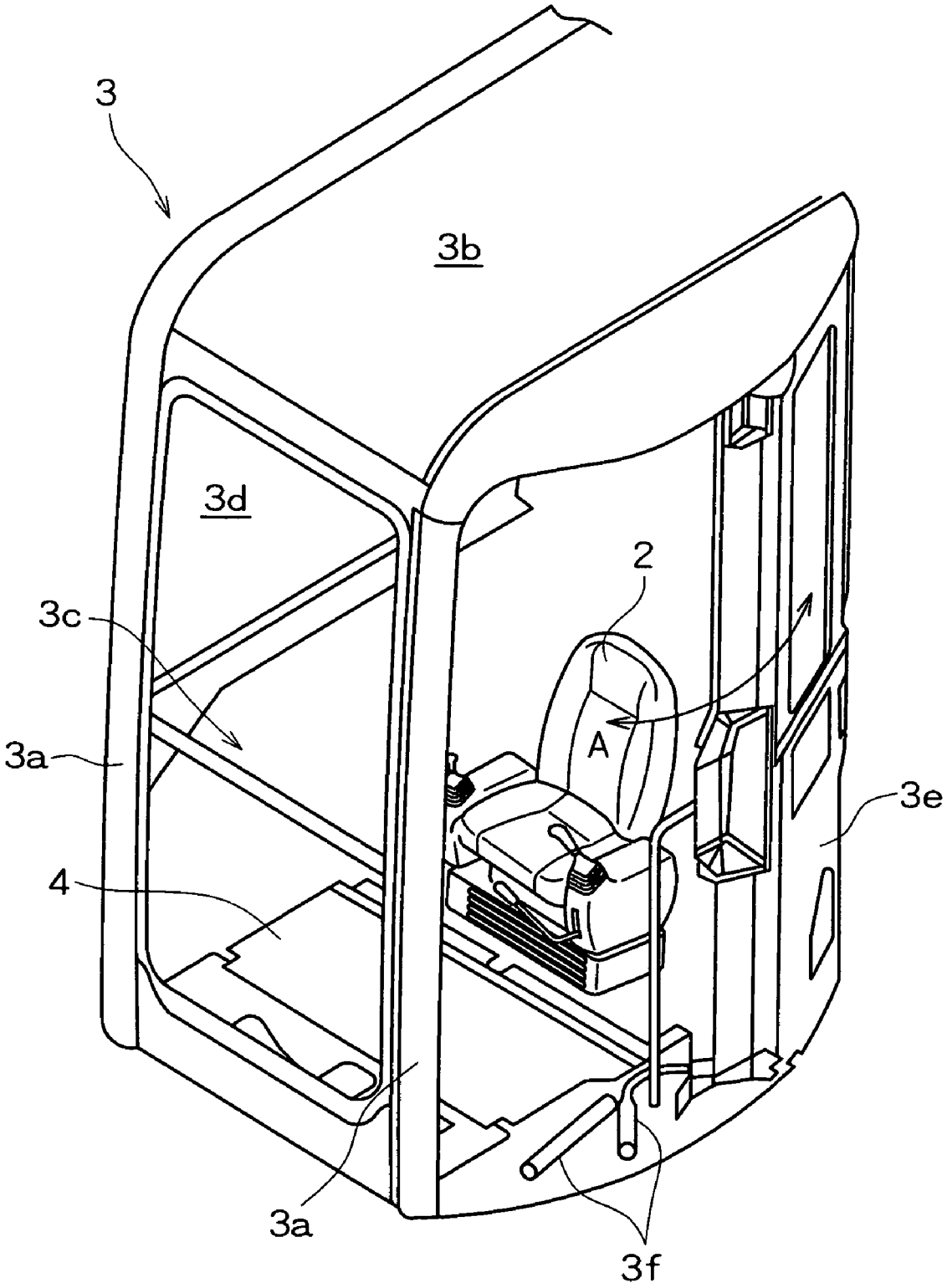
FIG. 3 is a perspective view showing the structure of a cabin in the case of the cab for a cabin specification.

FIG. 3 shows the structure in a case where a cabin 3 is attached to the operator's seat 2.

The cabin 3 includes a frame 3*a* surrounding the operator's seat 2, and a roof 3*b*. Glass panels 3*c* and 3*d* are provided on the front and right sides of the cabin 3, respectively. An openable door 3*e* to open and close in a sliding manner is provided on a platform of the cabin 3.

The door 3*e* has a circular arc shape as viewed in a plane, and is guided by a guide rail (not shown) to open and close in a longitudinal direction (the direction of arrow A).

The floor plate 4 disposed below the operator's seat 2 has a stepwise part 4*a* formed on its platform side, which part is formed so as to be located at a lower level in a downward direction by one step than the most part of the floor plate (the main surface of the floor plate). A device 3*f* for opening and closing the open-close door 3*e* is disposed on this stepwise part 4*a*.

Figure 4:
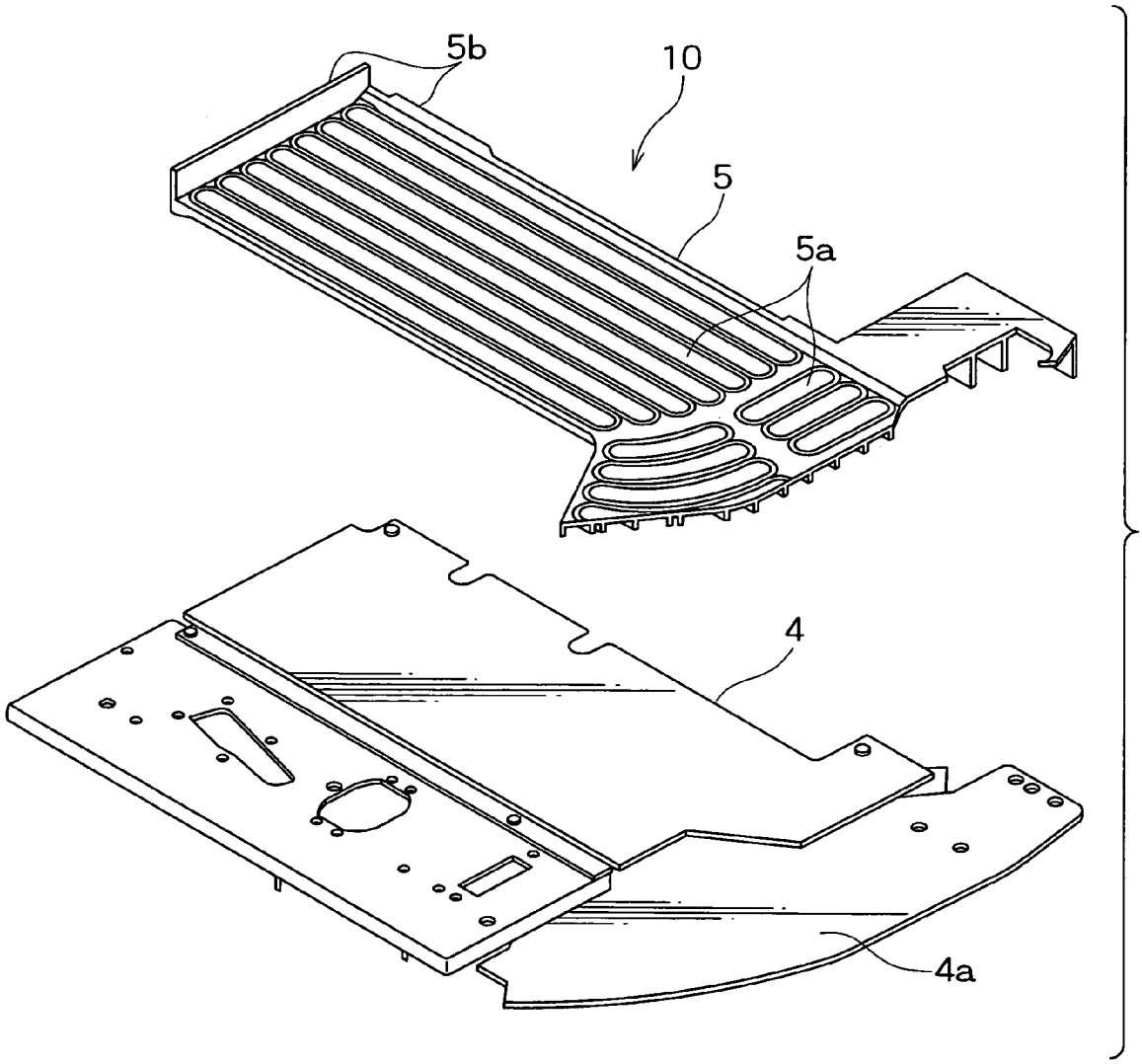
FIG. 4 is a perspective view showing the floor structure of the cabin specification.

FIG. 4 is an enlarged view of the floor plate 4.

In the figure, the floor plate 4 is disposed below an operator in the cab. The floor plate 4 can be constituted into a desired shape by processing a steel sheet and/or combining steel sheets.

In the present embodiment, the stepwise part 4*a* which provides a space to accommodate the device 3*f* for opening and closing the door is formed such that the part 4*a* is located at a lower level by one step on the platform side of the floor plate 4. Accordingly, this floor plate 4 can be commonly used for both specifications, that is, for the cabin specification having the device 3*f* and for the canopy specification without needing the device 3*f*.

On the other hand, there are prepared two types of floor mats 5 to be mounted on the floor plate 4, namely, one type for the cabin specification, and the other type for the canopy specification.

The floor mat 5 as shown in FIG. 4 is the first floor mat for the cabin specification and made of rubber. It should be noted that conventional floor mats can be used for being spread or mounted on the traveling lever 2*c*, the traveling pedal 2*d*, the swing pedal 2*e* for swinging the boom 6 in a lateral direction, and the optional pedal part 2*f* for operating the optional device such as a breaker, or an earth discharging plate.

On the surface of the first floor mat 5, an uneven pattern 5*a* which has pits and projections serving as a slip stopper is formed. On the side edge and rear edge thereof, frame portions 5*b* are provided in an upright posture for preventing discharge of sand and mud on the first floor mat 5 into the cab.

Figure 5:
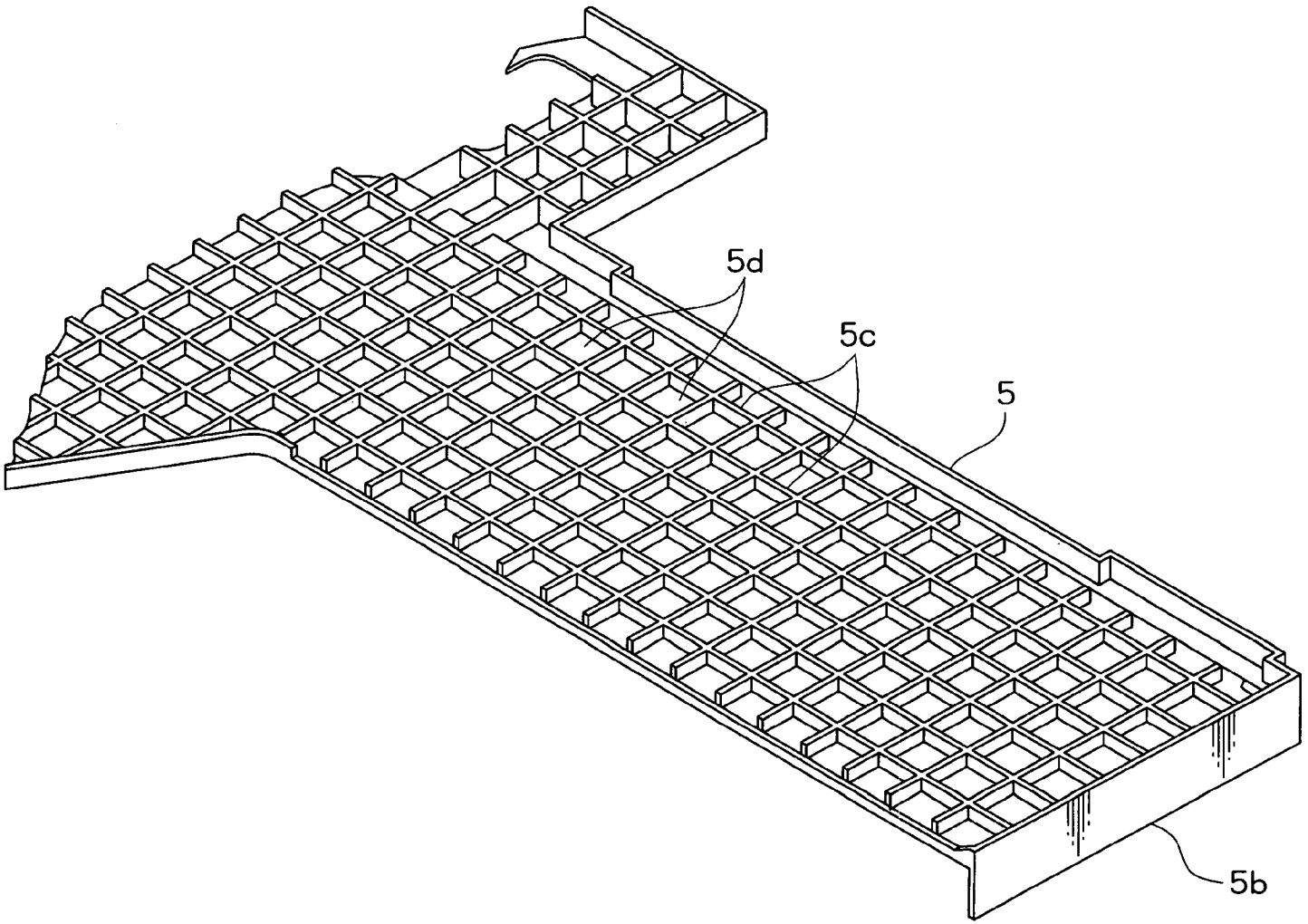
FIG. 5 is a perspective view showing the back side of a first floor mat of FIG. 4.

FIG. 5 shows the back side of the floor mat 5. As shown in the figure, so as to ensure strength, and to save weight and material, ribs 5*c* are formed on the back side of the floor mat 5 to create a grid pattern, so that a plurality of recesses 5*d* surrounded by these ribs 5*c* are formed.

Accordingly, the back side of the floor mat preferably has the grid pattern having a number of recesses so as to reduce its weight. In particularly, protrusions help enhance the effect of weight reduction.

The formation of the grid pattern maintains strength of the floor mat, while reducing its weight.

Thus, in the case of the cabin specification with the cabin 3 mounted, the device 3*f* for opening and closing the door 3*e* (see FIG. 3) in a sliding manner is received or housed in the stepwise part 4*a*. An upper cover (not shown) is disposed so as to cover the device 3*f*, whereby the stepwise part 4*a* is leveled by the upper cover. Accordingly, the first floor mat 5 having a substantially constant thickness can be mounted on the floor plate 4.

Now, the floor structure for the canopy specification will be described with reference to FIGS. 6 and 7.

Figure 6:
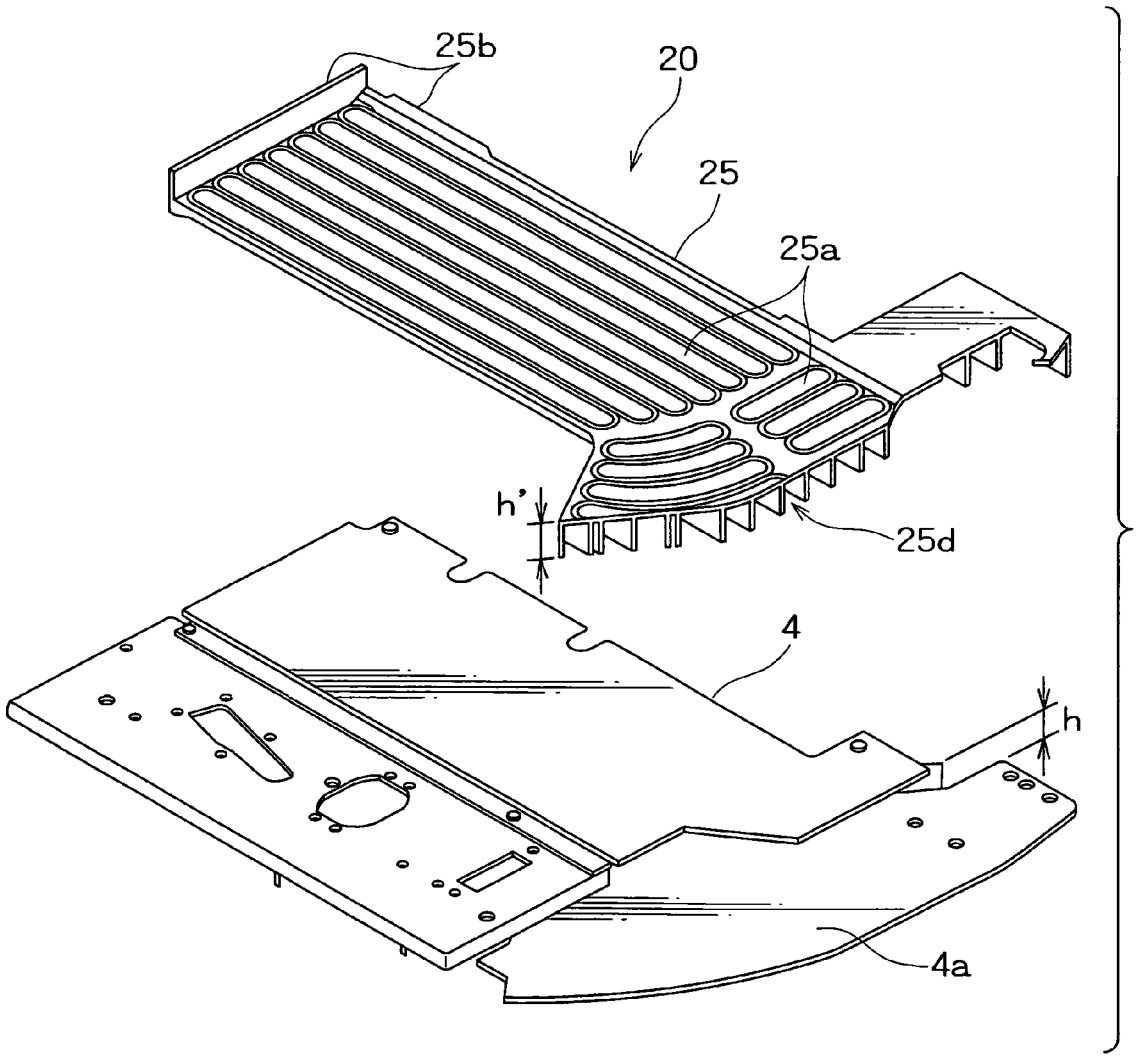
FIG. 6 is a perspective view showing the floor structure of a canopy specification.
Figure 7:
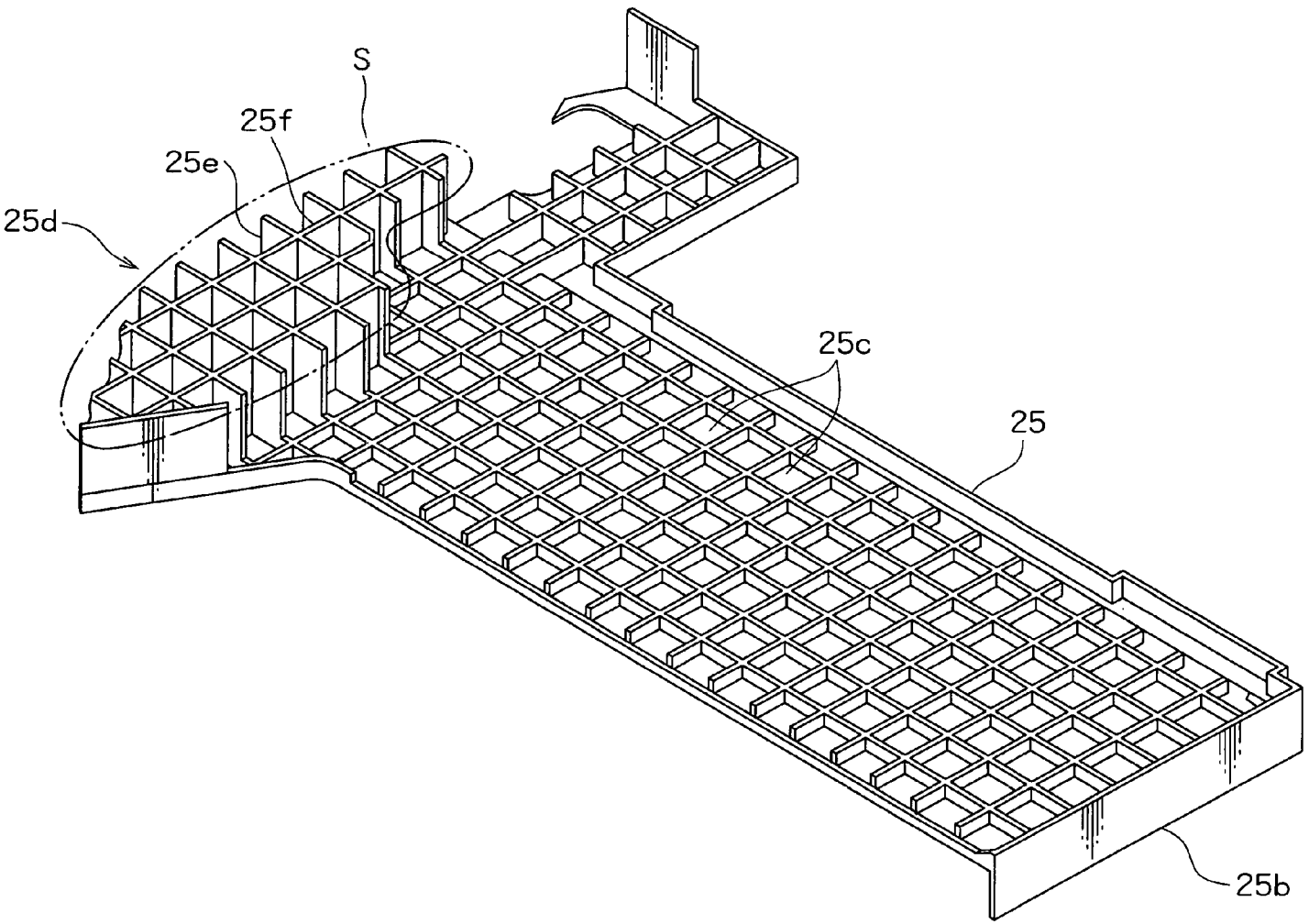
FIG. 7 is a perspective view showing the back side of a second floor mat of FIG. 6.

FIG. 6 shows the floor structure, and FIG. 7 shows a second floor mat provided in the floor structure as viewed from the back side.

In the following figures, elements that are in common to FIG. 4 are given the same reference characters, and the explanation thereof will be omitted hereinafter.

In the canopy specification, the cabin 3 (see FIG. 3) is unnecessary. Thus, the device 3*f* for opening and dosing the door 3*e* of the cabin 3 will be omitted. It should be noted that the floor plate 4, which can be commonly used for the cabin and canopy specifications, maintains the stepwise part 4*a* in both specifications.

For this reason, a second floor mat 25 with protrusions 25*d* disposed on the platform side, which will be described later, is mounted on the floor mat 4, to thereby fill in the stepwise part 4*a*.

This second floor mat 25 has a number of protrusions (leg portion) 25*d* provided in an upright posture, each having the substantially same length h' as the length h of the stepwise part 4*a*.

The leg portion 25*d*, as shown in FIG. 7, is protruded in a downward direction (in the upward direction in the case of the back side of FIG. 7) at the part S corresponding to the stepwise part 4*a*. This leg portion 25*d* is composed of ribs 25*e* molded in the lateral direction, and ribs 25*f* molded in the longitudinal direction to provide the grid pattern.

Since the leg portion 25*d* has to support the weight of an operator when the operator gets on and off the cab, it has enough strength not to be deformed easily.

The back surface part of the floor mat other than the part S corresponding to the stepwise part 4*a* has a number of recesses 25*c* formed in the grid pattern, in the same way as the first floor mat 5.

It is noted that on the front surface of the second floor mat 25, an uneven pattern 25*a* for a slip stopper is also formed (see FIG. 6). Frame portions 25*b* are provided in an upright posture on the side edge and rear edge of the mat, in the same way as the first floor mat 5.

As will be described in the above description, in the assembly method of the floor structure according to one preferred embodiment, for the cabin specification with the cabin 3 mounted, the device 3*f* is housed or received in the stepwise part 4*a* of the floor plate 4, so that the stepwise part is filled in and leveled by the upper cover of the device 3*f*. Thereafter the first floor mat 5 having the substantially constant thickness is mounted on the floor plate 4, thus constituting the floor.

On the other hand, for the canopy specification, the second floor mat 25 is mounted on the floor plate 4 with the protrusions 25*d* provided on the platform side of the second floor mat 25 to face the stepwise part 4*a* of the floor plate 4, so that the stepwise part 4*a* is filled in with the protrusions 25*d* to form an even leveled surface, thus constituting the floor.

In the above-mentioned embodiments, the rear small rotating type hydraulic excavator 1 has been described as one example of the construction machine to which the present invention is applied. The present invention is not limited thereto, and may be applied to an arbitrary construction machine which can selectively install a canopy and a cabin for opening and closing in a sliding manner.

It should be noted that the traveling lever 2*c* on the floor plate 4, the traveling pedal 2*d*, the swing pedal 2*e* for swinging the boom 6 in a lateral direction, and the optional pedal 2*f* for operating the optional device such as the breaker, or the earth discharging plate never limit the present invention, and are not essential. Further, various modifications to the design thereof may be possible on the basis of a basic concept of the present invention.

Although the invention has been described with reference to the preferred embodiments in the attached figures, it is noted that equivalents may be employed and substitutions made herein without departing from the scope of the invention as recited in the claims.

We claim:

1. A floor structure of a construction machine, comprising:

a canopy disposed above and covering an operator's seat via a support;

a floor plate disposed below said operator's seat, said floor plate having a stepwise part at its end edge on a platform side for an operator, the stepwise part being an extension of the floor plate and formed so as to be located at a lower level in a downward direction relative to the remainder of the floor plate; and a floor mat covering said floor plate including said stepwise part, said floor mat having a protrusion corresponding to said stepwise part, wherein said floor mat is arranged such that when said floor mat is mounted on said floor plate, said protrusion of the floor mat is fitted into the stepwise part to fill in said stepwise part so as to substantially level an upper surface of the floor mat.

2. The floor structure of a construction machine according to claim 1, wherein said floor mat has on its back side a plurality of recesses creating a grid pattern.

3. A method of assembling a floor structure of a construction machine, comprising the steps of:

forming a stepwise part at an end edge of a floor plate constituting said floor structure in such a manner that said stepwise part is an extension of the floor plate located at a lower level outside of said floor plate relative to the remainder of the floor plate;

on assembling the floor structure, when the floor structure is for a cabin specification on which a cabin with a door is mounted, housing a device for opening and closing said door in the stepwise part to fill in said stepwise part, while mounting on said floor plate a first floor mat having a substantially constant thickness; and on assembling the floor structure, when the floor structure is for a canopy specification on which a canopy without a door is mounted, mounting on said floor plate a second floor mat having a protrusion corresponding to said stepwise part, instead of said device, said protrusion being disposed at an end edge of the second floor mat, and being fitted into the stepwise part in such a manner that said protrusion fills in said stepwise part.

* * * * *